US009574274B2

(12) United States Patent
Chen et al.

(10) Patent No.: US 9,574,274 B2
(45) Date of Patent: Feb. 21, 2017

(54) PARTIAL OXIDATION OF METHANE (POM) ASSISTED SOLID OXIDE CO-ELECTROLYSIS

(71) Applicant: University of South Carolina, Columbia, SC (US)

(72) Inventors: Fanglin Chen, Irmo, SC (US); Yao Wang, Columbia, SC (US)

(73) Assignee: University of South Carolina, Columbia, SC (US)

( * ) Notice: Subject to any disclaimer, the term of this patent is extended or adjusted under 35 U.S.C. 154(b) by 0 days.

(21) Appl. No.: 14/690,687

(22) Filed: Apr. 20, 2015

(65) Prior Publication Data

US 2015/0299871 A1 Oct. 22, 2015

Related U.S. Application Data

(60) Provisional application No. 61/995,816, filed on Apr. 21, 2014.

(51) Int. Cl.
*C25B 1/00* (2006.01)
*C25B 1/02* (2006.01)
(Continued)

(52) U.S. Cl.
CPC . *C25B 1/02* (2013.01); *C25B 1/00* (2013.01); *C25B 9/08* (2013.01); *C25B 9/10* (2013.01); *C25B 11/04* (2013.01); *C25B 13/04* (2013.01)

(58) Field of Classification Search
CPC ..... C25B 1/00; C25B 1/02
See application file for complete search history.

(56) References Cited

U.S. PATENT DOCUMENTS

2007/0163889 A1* 7/2007 Kato ..... C25B 1/04 205/637
2008/0029388 A1* 2/2008 Elangovan ..... C25B 1/02 204/242

(Continued)

OTHER PUBLICATIONS

Y. Wang, T. Liu, S. Fang, G. Xiao, H. Wang, F. Chen. "A novel clean and effective syngas production system based on partial oxidation of methane assisted solid oxide co-electrolysis process" Journal of Power Sources. Nov. 21, 2014. vol. 277. pp. 261-267.*

(Continued)

*Primary Examiner* — Steven A. Friday
(74) *Attorney, Agent, or Firm* — Dority & Manning, P.A.

(57) ABSTRACT

Methods for simultaneous syngas generation by opposite sides of a solid oxide co-electrolysis cell are provided. The method can comprise exposing a cathode side of the solid oxide co-electrolysis cell to a cathode-side feed stream; supplying electricity to the solid oxide co-electrolysis cell such that the cathode side produces a product stream comprising hydrogen gas and carbon monoxide gas while supplying oxygen ions to an anode side of the solid oxide co-electrolysis cell; and exposing the anode side of the solid oxide co-electrolysis cell to an anode-side feed stream. The cathode-side feed stream comprises water and carbon dioxide, and the anode-side feed stream comprises methane gas such that the methane gas reacts with the oxygen ions to produce hydrogen and carbon monoxide. The cathode-side feed stream can further comprise nitrogen, hydrogen, or a mixture thereof.

11 Claims, 5 Drawing Sheets

(51) Int. Cl.

| | |
|---|---|
| ***C25B 9/08*** | (2006.01) |
| ***C25B 9/10*** | (2006.01) |
| ***C25B 13/04*** | (2006.01) |
| ***C25B 11/04*** | (2006.01) |

(56) References Cited

U.S. PATENT DOCUMENTS

2008/0060935 A1* 3/2008 Hartvigsen ..... C25B 1/02 204/242
2009/0071841 A1* 3/2009 Pal ..... C01B 3/50 205/638
2009/0235587 A1* 9/2009 Hawkes ..... C10J 3/00 48/202
2010/0062312 A1* 3/2010 Larsen ..... B01D 67/0041 429/500
2011/0062017 A1* 3/2011 Elangovan ..... C25B 1/02 204/242
2011/0081596 A1* 4/2011 Chen ..... H01M 4/9016 429/483
2011/0206566 A1* 8/2011 Stoots ..... C25B 1/04 422/186.04
2012/0003552 A1* 1/2012 Barnett ..... C25B 1/02 429/422
2012/0014852 A1* 1/2012 Huang ..... B01D 53/228 423/210.5
2012/0228150 A1* 9/2012 Kang ..... C25B 11/0452 205/555
2013/0122381 A1* 5/2013 Kang ..... H01M 8/06 429/408
2014/0194539 A1* 7/2014 Hammad ..... C01B 3/38 518/704
2014/0272734 A1* 9/2014 Braun ..... C10K 1/04 431/11
2015/0368818 A1* 12/2015 Pedersen ..... C25B 1/04 204/267

OTHER PUBLICATIONS

X. Chen, C. Guan, G. Xiao, X. Du, J-Q. W. "Syngas production by high temperature steam/CO2 coelectrolysis using solid oxide electrolysis cells" Faraday Discussions. Mar. 23, 2015. vol. 182. pp. 341-351.*

L. Lei, Y. Wang, S. Fang, C. Ren, T. Liu, F. Chen. "Efficient syngas generation for electricity storage through carbon gasification assisted solid oxide co-electrolysis" Applied Energy. Jul. 1, 2016. vol. 173. pp. 52-58.*

L. Chen, F. Chen, C. Xia. "Direct synthesis of methane from CO2-H2O coelectrolysis in tubular solid oxide electrolysis cells" Energy & Environmental Science. Oct. 9, 2014. vol. 12. pp. 4018-4022.*

Z. Zhan, W. Kobsiriphat, J.R. Wilson, M. Pillai, I. Kim, S.A. Barnett. "Syngas production by coelectrolysis of CO2/H2O: The basis for a renewable energy cycle" Energy & Fuels. May 15, 2009. vol. 23. pp. 3089-3096.*

* cited by examiner

PARTIAL OXIDATION OF METHANE (POM) ASSISTED SOLID OXIDE CO-ELECTROLYSIS

PRIORITY INFORMATION

The present application claims priority to U.S. Provisional Patent Application Ser. No. 61/995,816 titled "Partial Oxidation of Methane (POM) Assisted Solid Oxide Co-Electrolysis" of Chen, et al, filed on Apr. 21, 2014, the disclosure of which is incorporated by reference herein.

GOVERNMENT SUPPORT CLAUSE

This invention was made with government support under DE-SC0001061 awarded by US Department of Energy. The government has certain rights in the invention.

BACKGROUND

The ever-increasing consumption of fossil fuels and their unfavorable burning products, $CO_2$, are leading the society into serious energy shortage and environmental issues. Alternative energy technologies with low $CO_2$ emission are urgently desired to meet the demands. Solid oxide co-electrolysis cell offers a potential way to convert surplus renewable electricity into easily transportable chemical energy by splitting $H_2O$ and $CO_2$ into syngas (a mixture of CO and $H_2$), which can be used as feedstock through the subsequent well-established Fischer-Tropsch (F-T) process to produce liquid synthetic fuel.

However, there are still many challenges before it becomes practically feasible. Solid oxide co-electrolysis cell is in principle a concentration cell, which performs according to the gas conditions in both electrode sides. For the current solid oxide co-electrolysis cell system, the cathode is typically composed of Ni-based material, which is easily oxidized losing its electrical and catalytic properties. Thus, some reduced gases such $H_2$ and/o CO are required to feed together with the co-electrolysis reactant $CO_2$ and $H_2O$ to maintain the reducing atmosphere in the cathode. Meanwhile, the anode is often directly exposed to air, and the oxygen gas produced during the co-electrolysis is normally emitted as an exhaust or collected as it forms. It is a huge waste or at least not effectively utilized, deserving to generate more commercial values. To make things worse, the current operating conditions for solid oxide co-electrolysis cells can cause an extremely large difference of the oxygen pressure between two electrodes. The oxygen pressure gradient results in a high open circuit voltage up to 1.0 V at 800° C. according to the Nernst equation. It is known, however, that a voltage higher than the open circuit voltage ("OCV" or "$V_{OC}$") is required to generate the co-electrolysis. So the current solid oxide co-electrolysis cell has a very low electrolysis efficiency since most of the electricity is consumed to overcome the initial energy barrier resulted from the oxygen pressure gradient not for producing the real electrolysis.

SUMMARY

Objects and advantages of the invention will be set forth in part in the following description, or may be obvious from the description, or may be learned through practice of the invention.

Methods are generally provided for simultaneous syngas generation by opposite sides of a solid oxide co-electrolysis cell. In one embodiment, the method comprises exposing a cathode side of the solid oxide co-electrolysis cell to a cathode-side feed stream; supplying electricity to the solid oxide co-electrolysis cell such that the cathode side produces a product stream comprising hydrogen gas and carbon monoxide gas while supplying oxygen ions to an anode side of the solid oxide co-electrolysis cell; and exposing the anode side of the solid oxide co-electrolysis cell to an anode-side feed stream. The cathode-side feed stream comprises water and carbon dioxide, and the anode-side feed stream comprises methane gas such that the methane as reacts with the oxygen ions to produce hydrogen and carbon monoxide. In one embodiment, the cathode-side feed stream further comprises nitrogen, hydrogen, or a mixture thereof.

In one embodiment, the method further includes exposing the cathode-side feed stream to heat such that the cathode-side feed stream has a temperature of about 650° C. and about 1000° C., when exposed to the cathode side of the solid oxide co-electrolysis cell.

The cathode-side feed stream can have a flow ratio of carbon dioxide to water such that the product stream produced by has a ratio of hydrogen to carbon monoxide from about 1:1 to about 4:1 about 2 to 1).

The methane gas and the electrolysis current in the anode can have a flow ratio and electric current produce a ratio of hydrogen and carbon monoxide of about 1:1 to about 4:1 (e.g., about 2 to 1).

The method can also be operated in reverse bias, where the cathode is operated as an anode and the anode is operated as a cathode.

A symmetrical solid oxide co-electrolysis cell is also generally provided. In one embodiment, the symmetrical solid oxide co-electrolysis cell comprises: a porous cathode; a porous anode; and a dense electrolyte between the cathode and the anode, wherein the electrolyte support comprises $La_{0.9}Sr_{0.1}Ga_{0.8}Mg_{0.2}O_3$, and wherein an anode and a cathode each comprises $Sr_2Fe_{1.5}Mo_{0.5}O_{6-\delta}$ and $Sm_{0.2}Ce_{0.8}O_{1.9}$.

The method can include utilizing a dry-pressing method to prepare the electrolyte support. The $Sr_2Fe_{1.5}Mo_{0.5}O_{6-\delta}$ can be synthesized by a microwave-assisted combustion method, and the $Sm_{0.2}Ce_{0.8}O_{1.9}$ can be synthesized by a glycine assisted combustion method.

Other features and aspects of the present invention are discussed in greater detail below.

BRIEF DESCRIPTION OF THE DRAWINGS

A full and enabling disclosure of the present invention, including the best mode thereof to one skilled in the art, is set forth more particularly in the remainder of the specification, which includes reference to the accompanying figures.

DEFINITIONS

Figure 1A:
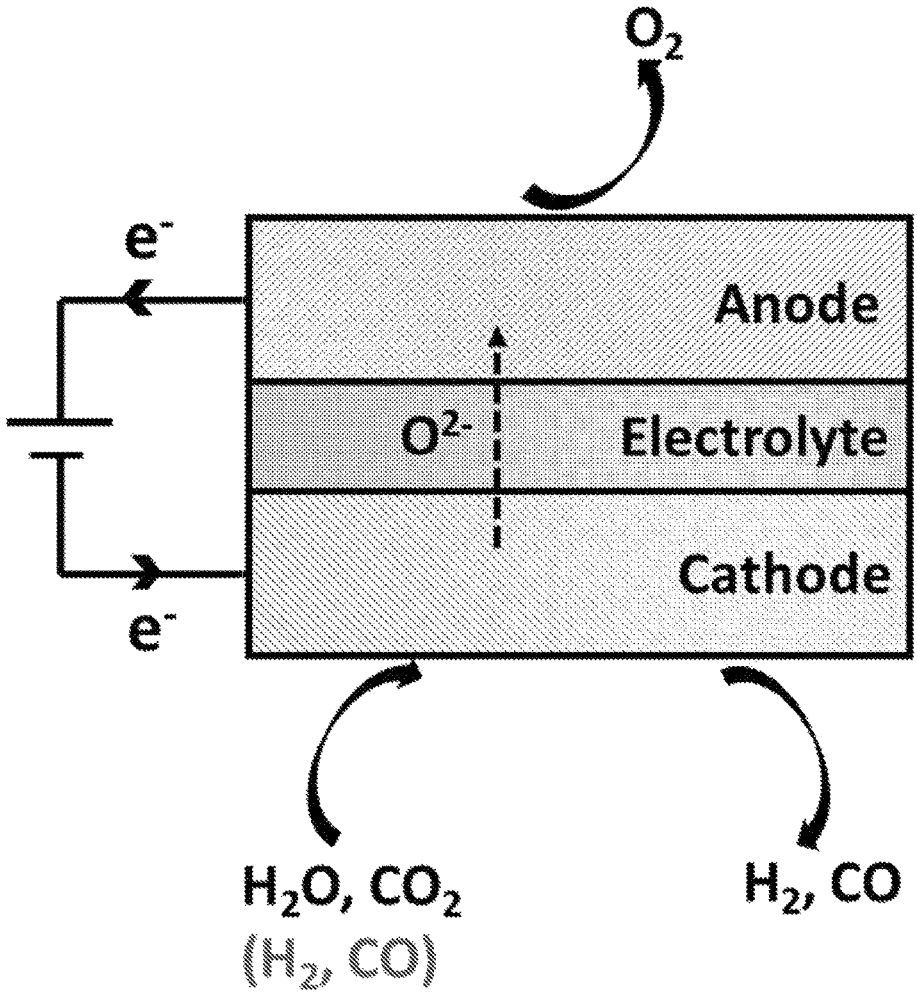
Fig. 1a (Prior Art)
FIG. 1*a* illustrates a schematic diagram of a solid oxide co-electrolysis cell operated in conventional mode.

Chemical elements are discussed in the present disclosure using their common chemical abbreviation, such as commonly found on a periodic table of elements. For example, hydrogen is represented by its common chemical abbreviation H; helium is represented by its common chemical abbreviation He; and so forth.

As used herein, the term "syngas" refers to a gaseous mixture primarily of hydrogen ($H_2$), carbon monoxide (CO). While other gases may be present in the mixture (e.g., carbon dioxide ($CO_2$), methane, etc.), the syngas is typically 50% or greater $H_2$ and CO by volume, more typically 75% or greater $H_2$ and CO by volume, and even more typically 90% or greater $H_2$ and CO by volume.

DETAILED DESCRIPTION

Reference now will be made to the embodiments of the invention, one or more examples of which are set forth below. Each example is provided by way of an explanation of the invention, not as a limitation of the invention. In fact, it will be apparent to those skilled in the art that various modifications and variations can be made in the invention without departing from the scope or spirit of the invention. For instance, features illustrated or described as one embodiment can be used on another embodiment to yield still a farther embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied exemplary constructions.

Systems and methods are generally provided for simultaneously generating synthetic gas (syngas) in both electrode compartments of a solid oxide co-electrolysis cell by integrating solid oxide co-electrolysis and partial oxidation of methane (POM) process. A symmetrical solid oxide co-electrolysis cell is also generally provided for POM assisted co-electrolysis.

In accordance with certain embodiments of the present disclosure, a method is provided for simultaneously generating syngas in both sides of a solid oxide co-electrolysis cell. The method includes solid oxide co-electrolysis cell and partial oxidation of methane. A source of syngas in mixture of hydrogen gas ($H_2$) and carbon monoxide (CO) can be formed in the cathode side of a solid oxide co-electrolysis cell by splitting steam ($H_2O$) and carbon dioxide ($CO_2$) with the supply of external electricity. Another source of syngas can be formed simultaneously in the anode side by introducing methane to react with oxygen ions produced during the co-electrolysis in the cathode. The introduction of methane can decrease the electric input for the solid oxide co-electrolysis process due to the reduced oxygen pressure gradient between two electrodes. The introduction of methane can also promote the co-electrolysis process with a higher conversion rate due to one of the products, oxygen ions, are timely consumed by reacting with methane.

In certain embodiments of the present disclosure, a symmetrical solid oxide co-electrolysis cell is described. The fabrication includes synthesizing porous electrodes and applying the electrodes on a dense electrolyte support. In the present disclosure, an effective strategy for syngas generation is described by combining solid oxide co-electrolysis cell and partial oxidation of methane.

Figure 1B:
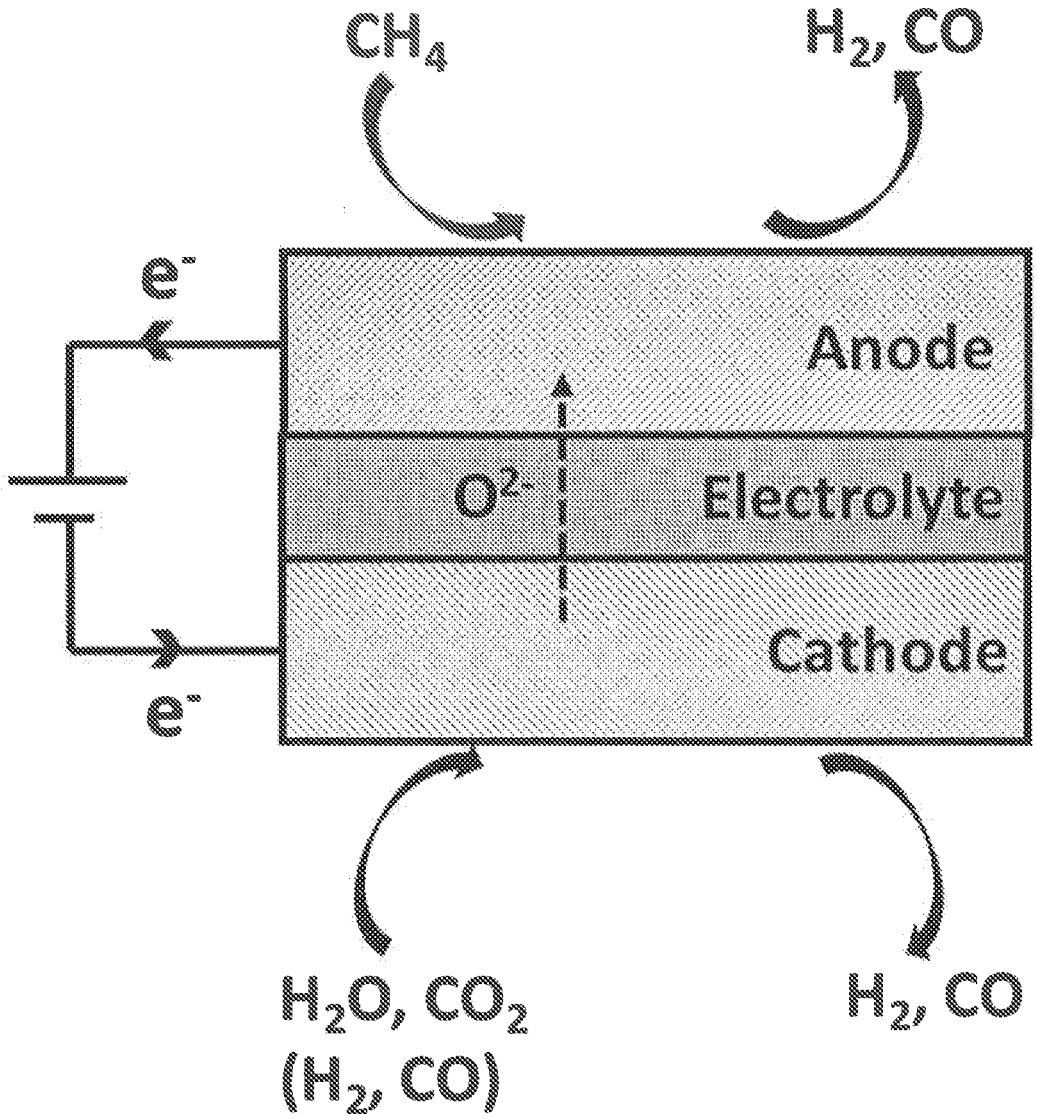
FIG. 1*b* illustrates a schematic diagram of a solid oxide co-electrolysis cell operated in assisted mode.

A simplified diagram of a single solid oxide co-electrolysis cell that may be used with particular embodiments of the invention is illustrated in FIG. 1. A feed stream of steam ($H_2O$) and carbon dioxide ($CO_2$) is introduced to the cathode side of the solid oxide co-electrolysis cell, where steam ($H_2O$) and carbon dioxide ($CO_2$) receive electrons from the external power to produce hydrogen gas ($H_2$), carbon monoxide (CO) and oxygen ions ($O^{2-}$), described as reactions (1) and (2), $$H_2O+2e^-\rightarrow H_2+O^{2-} \quad (1)$$

$$CO_2+2e^-\rightarrow CO+O^{2-} \quad (2)$$

A stream of methane (instead of air/$O_2$ as in the conventional mode shown in FIG. 1*a*) is fed to the anode to react with the oxygen ions ($O^{2-}$) pumped from the cathode, CO and $H_2$ are then formed as another source of syngas in the anode by the partial oxidation of methane, described in reaction (3).

$$CH_4+O^{2-}\rightarrow CO+2H_2+2e^- \quad (3)$$

Thus, the total reaction process for the solid oxide co-electrolysis cell operated in conventional (FIG. 1*a*) and POM assisted (FIG. 1*b*) modes can be written as reaction (4) and (5), respectively:

$$H_2O+CO_2\rightarrow H_2+CO+O_2 \quad (4)$$

$$2CH_4+H_2O+CO_2\rightarrow 5H_2+3CO \quad (5)$$

Figure 2A:
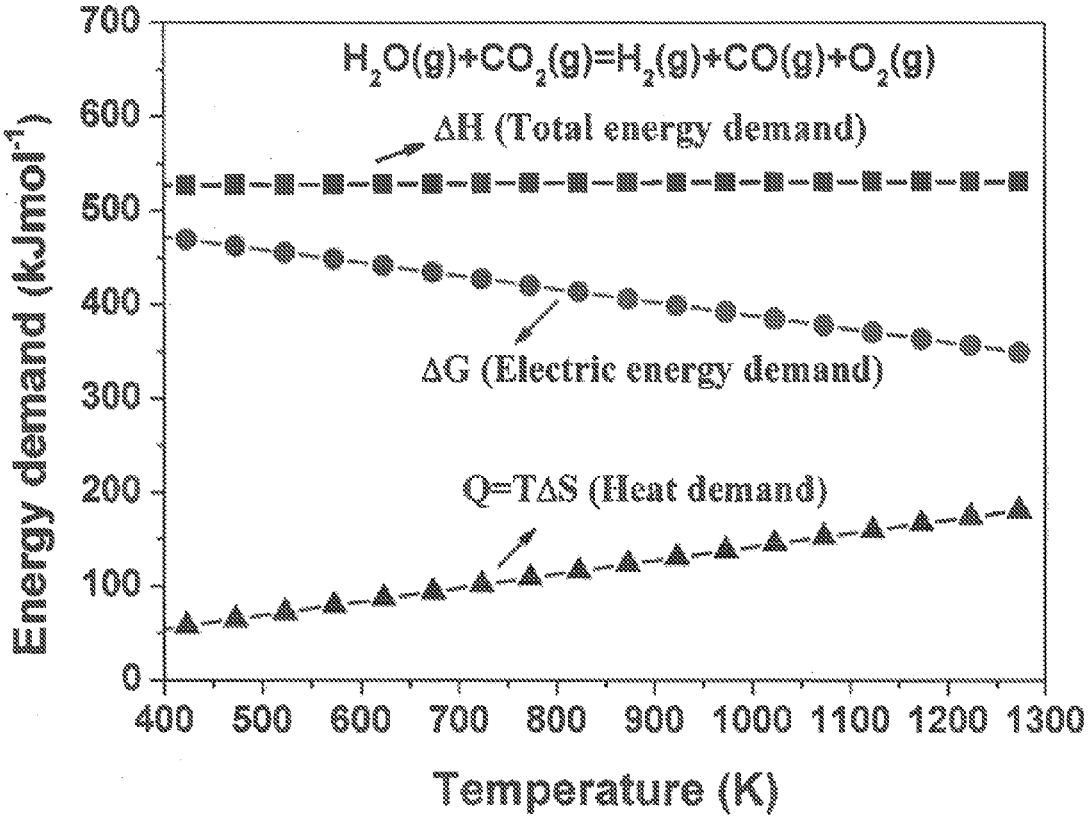
FIG. 2*a* illustrates the thermodynamic calculation as function of temperature for co-electrolysis process in conventional mode.
Figure 2B:
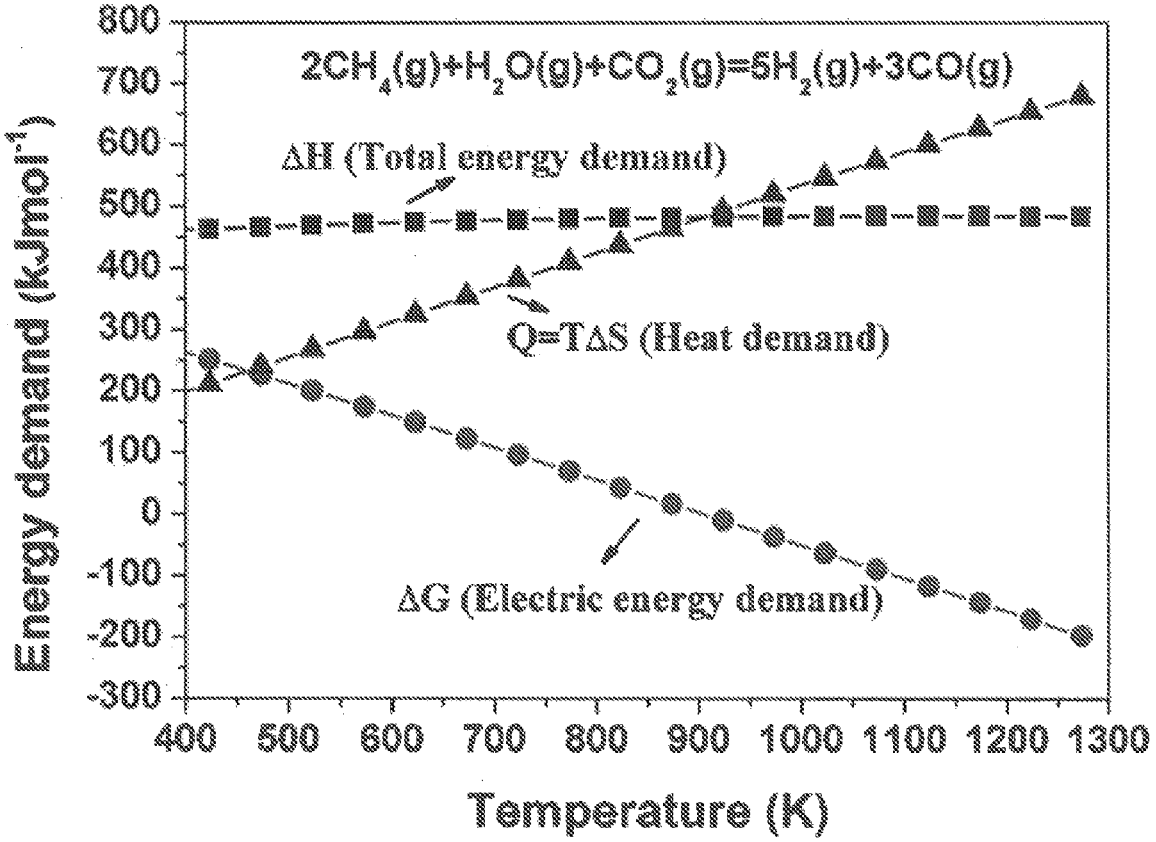
FIG. 2*b* illustrates the thermodynamic calculation as function of temperature for co-electrolysis process in POM assisted mode.

The thermodynamic parameters change quite a lot for the two different co-electrolysis modes. When the co-electrolysis process is performed by the conventional mode as described in reaction (4), it totally requires an amount of energy about 528 $kJmol^{-1}$. Which presents nearly consistent with the temperature from 400 to 1300 K. Although the electric energy demand shown in FIG. 2*a* has accordingly decreased at high temperature with the significantly increase of heat due to the positive entropy, $\Delta S$, the $\Delta G$ still maintains at a high positive value above 300 $kJmol^{-1}$ even at 1300 K. This inevitable electric input has definitely degraded the competitiveness of the conventional solid oxide co-electrolysis technique, since electricity is much more expensive than joule heat. However, when the co-electrolysis process is performed by the POM assisted mode as described in reaction (5), the total energy has decreased 9% from the previous 528 to 481 $kJmol^{-1}$, suggesting a substantial improvement in efficiency is proposed to achieve. Because parts of total energy demand for the endothermic co-electrolysis process can be compensated by heat released from the exothermic POM reaction. Moreover, it should be specially noticed that the electric energy demand $\Delta G$ has reduced dramatically with temperature. After the temperature reaching 923 K, the $\Delta G$ becomes a totally negative value, suggesting that the POM assisted co-electrolysis reaction expressed as $2CH_4+H_2O+CO_2\rightarrow 5H_2+3CO$ can occur spontaneously without any electric input from an external power. It could further increase the competitiveness of the co-electrolysis technique if the heat required are supplied from the waste heat by-produced through other industrial processes.

There are several profound advantages for the POM assisted co-electrolysis process. First of all, it explores a potential utilization of oxygen gas produced during the co-electrolysis to generate additional commercial value. Second, synthesis gases with ideal $H_2$/CO ratio for subsequent synthesis reaction are proposed to produce in both electrodes sides of the solid oxide cell. Third, the addition of methane can also promote the current co-electrolysis process with a higher electrolysis efficiency, since the initial energy barrier caused by the huge oxygen pressure gradient under conventional solid oxide co-electrolysis process can be dramatically reduced by the substitution of methane to air $O_2$ in the anode, and parts of the energy demand for the co-electrolysis process can be compensated by the released heat from POM reactions. Furthermore, the partial oxidation of methane can also improve the co-electrolysis conversion rate, since one of the co-electrolysis products, $O^{2-}$, is constantly consumed by reacting with methane.

Examples

In the present disclosure, symmetrical $La_{0.9}Sr_{0.1}Ga_{0.8}Mg_{0.2}O_3$ (LSGM) electrolyte supported single cells with $Sr_2Fe_{1.5}Mo_{0.5}O_{6-\delta}$ (SFM)-40 wt % $Sm_{0.2}Ce_{0.8}O_{1.9}$ (SDC) as both the anode and the cathode were prepared. SFM was chosen for its excellent reduction/oxidation (redox) stability and high electrical properties in a large range of partial oxygen pressure. SDC was incorporated to increase the electrode ionic conductivity, and consequently improve the cell performance due to enlarged active reaction sites.

The SFM powders were synthesized by a glycine and citric acid assisted combustion method, $Sr(NO_3)_2$, $Fe(NO_3)_3.9H_2O$ and $(NH_4)_6Mo_7O_{24}.4H_2O$ were used as metal precursors, Glycine and citric acid were used to assist the combustion process. The as-prepared ash was fired at 1050° C. for 5 h to form the perovskite structure. The SDC powders were made by a glycine assisted combustion method. The LSGM electrolyte material was synthesized by the solid-state reaction.

The dense electrolyte support was prepared by pressing LSGM pellets and then sintered at 1400° C. for 5 h. The electrode inks consisting of 60 wt % SFM and 40 wt % SDC were screen printed on both sides of the electrolyte and then fired at 1100° C. for 2 h. The effective electrode area was about 0.33 $cm^{-2}$. Au paste was used as the current collector.

The $CO_2$, $H_2$ and $N_2$ fed to the cathode were exactly controlled by the mass flow controller (APEX, Alicat Scientific, U.S.). The water were added using a humidifier, and the water partial pressure was determined by the heating temperature of the water in the humidifier. The amount of water vapor in the gas mixture was continuously measured in the term of absolute humidity using a humidity sensor (Vaisala, HMP 337). The air for the conventional co-electrolysis mode and humidified $CH_4$ with 3% $H_2O$ for the POM assisted co-electrolysis mode fed to the anode were also exactly controlled by the mass flow controller (APEX, Alicat Scientific, U.S.).

The current-voltage curves were measured using a VersaSTAT (Pinceton Applied Research).

Figure 3:
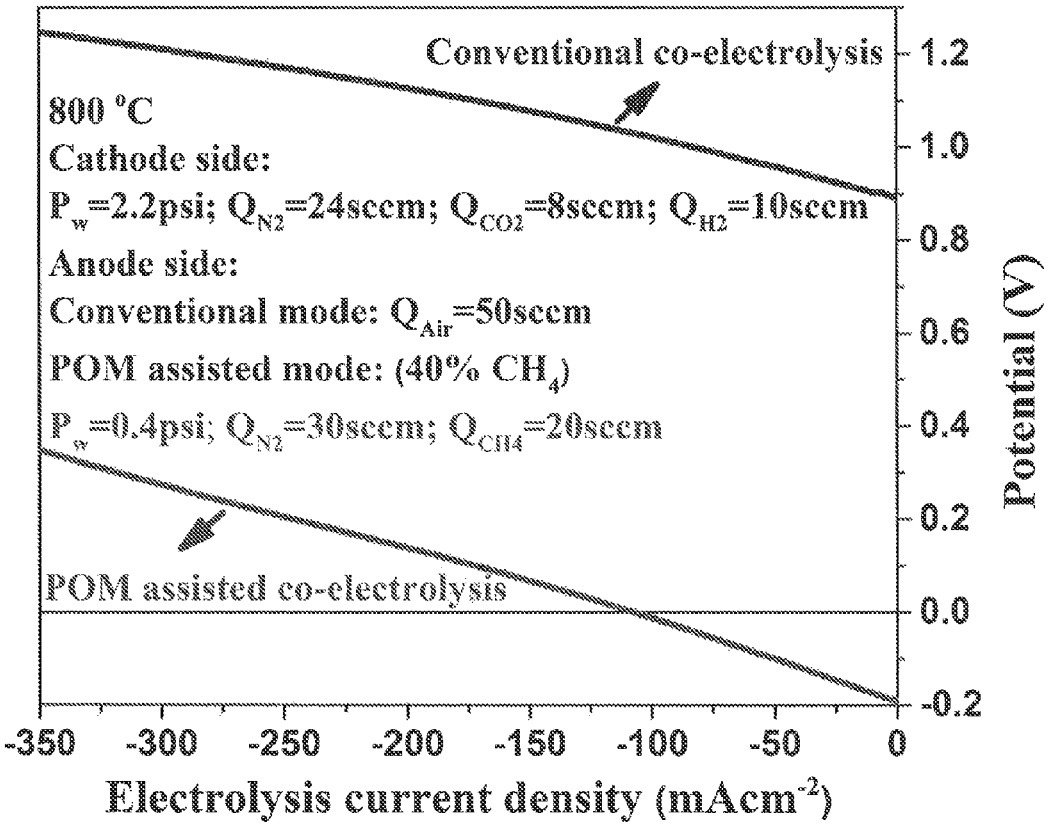
FIG. 3 illustrates IV curves for the SFM-40 wt % SDC/LSGM/SFM-40 wt % SDC cell operated in both conventional and POM assisted modes.

FIG. 3 shows the IV curves for the SFM-40 wt % SDC/LSGM/SFM-40 wt % SDC cell measured in both conventional and POM assisted modes. The gas conditions in the anode are constantly maintained the same as a mixture of 15% $H_2O$/15% $CO_2$/20% $H_2$/50% $N_2$. While the cathode is firstly kept in the air to perform the conventional co-electrolysis process, then it shifts to a methane consisted atmosphere to conduct the POM assisted mode. The curve measured under the POM assisted mode totally stays below the one measured under the conventional mode, indicating that a much lower potential is required to produce the same electrolysis current. For instance, the potential to produce 200 $mAcm^{-2}$ electrolysis current is 1.13 V for the normal co-electrolysis with the anode in the air, while the potential has decreased nearly one order to 0.14 V when the cell operates its anode in the methane. It really promotes the electrolysis efficiency with the assistance of methane due to the dramatic reduction of the electric input. Another important result indicating the advance of POM assisted co-electrolysis process is from the OCV. The value for the POM assisted co-electrolysis has dropped from a normally high positive 0.89 V of the conventional co-electrolysis process to a negative −0.2 V. The negative OCV demonstrates that the methane assisted co-electrolysis reaction has occurred spontaneously without any electric input. It will significantly improve the economic competitiveness of the solid oxide co-electrolysis technique, which is dominantly limited its large-scale application by intensive electricity cost. In particular, the introduction of methane in the anode performs a quite interesting behaviour within the potential range from −0.2 to 0V. On one hand, the positive power density indicates the symmetrical SFM-SDC/LSGM/SFM-SDC cell is exporting electric energy as a solid oxide fuel cell behaves. On the other hand, the positive over-potential compared with OCV suggests the $CO_2$—$H_2O$ side electrode are receiving electrons to perform $CO_2/H_2O$ electrolysis. At the same time, synthesis gases CO and $H_2$ are producing in both electrodes sides as expected in reaction (5). Both the current flow and syn as generation are driven by the instinctive chemical potential difference between the two electrodes without external power. It sounds amazing but really does happen through the partial oxidation of methane assisted co-electrolysis reaction. The current corresponding to the synthesis gas production continues to increase with the applied potential, and a high 350 $mAcm^{-2}$ electrolysis current is obtained at only 0.4 V, which is quite attractive for the low cost resulted from the reduced electricity input.

These and other modifications and variations to the present invention may be practiced by those of ordinary skill in the art, without departing from the spirit and scope of the present invention, which is more particularly set forth in the appended claims. In addition, it should be understood the aspects of the various embodiments may be interchanged both in whole or in part. Furthermore, those of ordinary skill in the art will appreciate that the foregoing description is by way of example only, and is not intended to limit the invention so further described in the appended claims.

What is claimed:

1. A method for simultaneous syngas generation by opposite sides of a solid oxide co-electrolysis cell, comprising:

exposing a cathode side of the solid oxide co-electrolysis cell to a cathode-side feed stream, wherein the cathode-side feed stream comprises water and carbon dioxide;

supplying electricity to the solid oxide co-electrolysis cell such that the cathode side produces a product stream comprising hydrogen gas and carbon monoxide gas while supplying oxygen ions to an anode side of the solid oxide co-electrolysis cell; and exposing the anode side of the solid oxide co-electrolysis cell to an anode-side feed stream, wherein the anode-side feed stream comprises methane gas such that the methane gas reacts with the oxygen ions to produce hydrogen and carbon monoxide.

2. The method of claim 1, wherein the cathode-side feed stream further comprises nitrogen.

3. The method of claim 1, wherein the cathode-side feed stream further comprises hydrogen.

4. The method of claim 1, wherein the cathode-side feed stream further comprises hydrogen and nitrogen.

5. The method of claim 1, further comprising:

exposing the cathode-side feed stream to heat such that the cathode-side feed stream has a temperature of about 650° C. and about 1000° C. when exposed to the cathode side of the solid oxide co-electrolysis cell.

6. The method of claim 1, wherein the cathode-side feed stream has a flow ratio of carbon dioxide to water such that the product stream produced by has a ratio of hydrogen to carbon monoxide from about 1:1 to about 4:1.

7. The method of claim 1, wherein the cathode-side feed stream has a flow ratio of carbon dioxide to water such that the product stream produced by has a ratio of hydrogen to carbon monoxide that is about 2 to 1.

8. The method of claim 1, wherein the methane gas and the electrolysis current in the anode produce a ratio of hydrogen and carbon monoxide of about 1:1 to about 4:1.

9. The method of claim 1, wherein the methane gas and the electrolysis current in the anode produce a ratio of hydrogen and carbon monoxide of about 2 to 1.

10. The method of claim 1, further comprising:

operating the cathode as an anode.

11. The method of claim 1, further comprising:

operating the anode as a cathode.

* * * * *